US007416080B1

(12) United States Patent
Langer

(10) Patent No.: US 7,416,080 B1
(45) Date of Patent: Aug. 26, 2008

(54) APPARATUS FOR BACTERIA REDUCTION

(75) Inventor: Wolfram Langer, Glieniecke\Nordbahn (DE)

(73) Assignee: Kryolan GmbH (DE)

( * ) Notice: Subject to any disclaimer, the term of this patent is extended or adjusted under 35 U.S.C. 154(b) by 327 days.

(21) Appl. No.: 10/757,853

(22) Filed: Jan. 13, 2004

(51) Int. Cl.
*B65D 39/14* (2006.01)
*B65D 71/00* (2006.01)
*A45D 44/18* (2006.01)

(52) U.S. Cl. ..... 206/361; 206/15.2; 206/581; 206/823; D4/116

(58) Field of Classification Search ..... 206/361 X, 206/362, 362.1, 362.3, 15.2 X, 15.3, 581 X, 206/823; D4/116 X, 132
See application file for complete search history.

(56) References Cited

U.S. PATENT DOCUMENTS

| | | | | |
|---|---|---|---|---|
| 2,096,975 | A * | 10/1937 | Revson | 206/15.2 |
| 2,177,504 | A * | 10/1939 | Thompson | 206/361 |
| D134,797 | S | 1/1943 | Lubkin | |
| 2,630,912 | A * | 3/1953 | Warner et al. | 206/15.2 |
| D204,449 | S | 4/1966 | Zavodsky et al. | D9/2 |
| D229,115 | S | 11/1973 | Costa | D86/10 G |
| 4,471,507 | A | 9/1984 | Schwartz | 15/176 |
| 5,992,617 | A * | 11/1999 | Couch et al. | 206/15.3 |
| 6,779,532 | B2 | 8/2004 | Dorf | 132/200 |
| 6,895,628 | B1 | 5/2005 | Anderson | 15/106 |
| 2003/0102010 | A1 | 6/2003 | Mays | 134/6 |
| 2005/0252823 | A1 * | 11/2005 | Roeder | 206/581 |

OTHER PUBLICATIONS

Hong Kong Enterprise, Aug. 2003, A-Winning Nice Products Ltd., Cosmetic Brushes circled at top, right and middle, left of p. 150.
Hong Kong Enterprise, Aug. 2003, Law Tai Hang Cosmetic Brush Factory, Cosmetic Brush Set with Case, Item No. CT 100, p. 191.
Hong Kong Enterprise, Aug. 2003, Minxin Brushes Products Co., Cosmetic Brushes, circled on p. 961.
Brushes by Karen, Inc., Cosmetic Brushes & Accessories, The Chisel Collection—Eye Brushes. Catalog [online]. [retrieved on Feb. 7, 2006]. Retrieved from the Internet <URL: http://web.archive/web/20000411195315/brushesbykaren.com/06-07 -chisel.html>, pp. 1 of 2.

* cited by examiner

*Primary Examiner*—Jila M Mohandesi
(74) *Attorney, Agent, or Firm*—Haverstock & Owens LLP

(57) ABSTRACT

The present invention is an apparatus and cosmetic brush for reducing bacteria. The apparatus includes a sterilized cosmetic brush in a re-useable enclosure, wherein the re-useable enclosure is designed to be used during the entire life span of the cosmetic brush. The re-useable enclosure shields the sterilized brush from bacteria during shipping and sale display. Once the apparatus and brush are purchased, the re-useable enclosure and the bacteria resistant brush handle prevent the growth and spread of bacteria to other brushes. Finally, the apparatus prevents bacteria spread and growth within the re-useable enclosure by not allowing the brush and handle to touch the inner surface of the re-useable enclosure.

4 Claims, 5 Drawing Sheets

APPARATUS FOR BACTERIA REDUCTION

FIELD OF THE INVENTION

The present invention relates generally to the field of cosmetic brushes. More specifically, the present invention relates to the field of bacteria reduction on a cosmetic brush.

BACKGROUND OF THE INVENTION

Cosmetic brushes, especially professional grade cosmetic brushes used in the theatre, motion picture and television industries, are typically constructed by affixing brush bristles of various materials to a wooden handle, or a handle made from some other material that is not resistant to the growth of bacteria on the handle as well as on the bristles of the brush. When wooden handles are utilized, the Goods and Manufacturing Practices (GMP) standards require that the wooden handles be coated with a paint or sealant to resist bacteria growth on the handle and further, to the brush itself.

Oftentimes, after continued use and repetitive cleaning, the paint or sealant applied to the handle is eventually removed. Paint thinner used to clean the make-up from theses types of brushes usually includes a solvent such as ethanol, acetone or petroleum ethylene. Such solvents damage the paint, thus exposing the wooden handle to bacteria and providing a bacteria friendly medium for the bacteria to grow.

The GMP standards also require that brushes be sterilized and packaged before being shipped to retailers. Most manufacturers ship the brushes in a temporary packaging so that once the brushes reach the retailer, they can be removed from the temporary packaging and displayed for sale. This packaging and shipping method wastes the sterilization process and effectuates a sale display that is prone to bacteria spread, as the brushes are in close proximity to each other or even touching each other, and not displayed in packaging of any kind.

Lastly, when these types of brushes are utilized in the industry, it is common for the cosmetology artists to use and store these brushes much in the same way as they are displayed for sale. In other words, the brushes are placed in close proximity to each other and are most often in a pile. This type of storage and display arrangement, combined with the exposure of the wooden handle after continued use and cleaning, promotes bacteria growth and spread on and among a collection of brushes. As will be apparent to one skilled in the art, other contaminants such as, but not limited to, viruses, allergins, mold and fungi can and do grow and spread in current brush designs. The present invention seeks to solve the growth and spread of such contaminants as well. It should be noted that use of the words contaminated and bacteria in this disclosure are inclusive of other contaminants known in the art as described above.

SUMMARY OF THE INVENTION

The present invention is an apparatus and cosmetic brush for reducing bacteria. The apparatus includes a sterilized cosmetic brush in a re-useable enclosure, wherein the re-useable enclosure is designed to be used during the entire life span of the cosmetic brush. The re-useable enclosure shields the sterilized brush from bacteria during shipping and sale display. Once the apparatus and brush are purchased, the re-useable enclosure and the bacteria resistant brush handle prevent the growth and spread of bacteria to other brushes. Finally, the apparatus prevents bacteria spread and growth within the re-useable enclosure by not allowing the brush and handle to touch the inner surface of the re-useable enclosure.

In one aspect of the present invention, an apparatus for resisting the growth and spread of contaminants comprises a brush including a handle portion, wherein the handle portion is fashioned from a contaminant resistant material, at least one endcap including an aperture, wherein the aperture is fashioned to receive the handle portion of the brush and an enclosure including at least one opening, wherein the at least one endcap is fashioned to close the at least one opening, and further wherein when the handle portion of the brush is inserted into the aperture and the at least one endcap is inserted into the at least one opening, the brush in entirely within the enclosure and configured such that the brush is not in contact with an inner surface of the enclosure.

The handle portion of the brush is fashioned from a stainless steel material and includes an upper handle portion and a lower handle portion, wherein the lower handle portion is inserted into the aperture. The apparatus further comprises a set of bristles coupled to the upper handle portion of the brush with a crimp. The handle portion of the brush can be fashioned from a plastic material. The enclosure has a cylindrical shape, wherein the at least one opening is positioned at the end of the cylinder. The enclosure is fashioned from a contaminant resistant material and a transparent material.

The at least one opening and the at least one endcap have a round shape, further wherein the at least one endcap includes a plug configured to be inserted into the at least one opening, wherein the plug is configured to substantially maintain sufficient contact with the inner surface of the enclosure and filler material configured in the plug such that the aperture can be fashioned into the filler material.

In another aspect of the present invention, an apparatus for resisting the growth and spread of contaminants comprises means for brushing including means for holding, wherein the holding means are fashioned from a contaminant resistant material, means for closing including means for receiving, wherein the receiving means are fashioned to receive the holding means and means for enclosing including at least one opening, wherein the closing means are fashioned to close the at least one opening, and further wherein when the holding means are inserted into the receiving means and the closing means are inserted into the at least one opening, the brushing means are entirely within the enclosing means and configured such that the brushing means are not in contact with an inner surface of the enclosing means.

The holding means are fashioned from a stainless steel material. The holding means include an upper holding means and a lower holding means, wherein the lower holding means is inserted into the receiving means. The apparatus further comprises a set of bristles coupled to the upper holding means with a crimp. The holding means can also be fashioned from a plastic material. The enclosing means have a cylindrical shape, wherein the at least one opening is positioned at the end of the cylinder. The enclosing means are fashioned from a contaminant resistant material and a transparent material.

The at least one opening and the closing means have a round shape, further wherein the closing means include means for plugging configured to be inserted into the at least one opening, wherein the plugging means is configured to substantially maintain sufficient contact with the inner surface of the enclosing means to remain in place until removed and means for filling configured in the plugging means such that the receiving means can be fashioned in the filling means.

In yet another aspect of the present invention, a cosmetic brush for resisting the growth and spread of contaminants comprising a handle portion, wherein the handle portion is fashioned from a contaminant resistant material and a set of bristles coupled to the handle portion of the cosmetic brush. The cosmetic brush further comprises at least one endcap including an aperture, wherein the aperture is fashioned to receive the handle portion of the cosmetic brush and an enclosure including at least one opening, wherein the at least one endcap is fashioned to close the at least one opening, and further wherein when the handle portion of the cosmetic brush is inserted into the aperture and the at least one endcap is inserted into the at least one opening, the cosmetic brush is entirely within the enclosure and configured such that the cosmetic brush is not in contact with an inner surface of the enclosure.

The handle portion of the cosmetic brush is fashioned from a stainless steel material. The handle portion of the cosmetic brush includes an upper handle portion and a lower handle portion, wherein the lower handle portion is inserted into the aperture and the set of bristles are coupled to the upper handle portion of the cosmetic brush with a crimp. The handle portion of the cosmetic brush can also be fashioned from a plastic material. The enclosure has a cylindrical shape, wherein the at least one opening is positioned at the end of the cylinder. The enclosure is fashioned from a contaminant resistant material and a transparent material.

The at least one opening and the endcap have a round shape, further wherein the endcap includes a plug configured to be inserted into the at least one opening, wherein the plug is configured to substantially maintain sufficient contact with the inner surface of the enclosure to remain in place until removed and filler material configured in the plug such that the aperture can be fashioned in the filler material.

In yet another aspect of the present invention, an enclosure for resisting the growth and spread of contaminants comprises at least one endcap including an aperture and at least one opening, wherein the at least one endcap is fashioned to close the at least one opening when the at least one endcap is inserted into the at least one opening, and further wherein the enclosure houses a brush having a handle portion, wherein the handle portion is fashioned from a contaminant resistant material.

The aperture is fashioned to receive the handle portion of the cosmetic brush, and further wherein when the handle portion of the cosmetic brush is inserted into the aperture and the at least one endcap is inserted into the at least one opening, the cosmetic brush is entirely within the enclosure and configured such that the cosmetic brush is not in contact with an inner surface of the enclosure. The handle portion of the cosmetic brush is fashioned from a stainless steel material. The handle portion of the cosmetic brush includes an upper handle portion and a lower handle portion, wherein the lower handle portion is inserted into the aperture. A set of bristles are coupled to the upper handle portion of the cosmetic brush with a crimp. The handle portion of the cosmetic brush is fashioned from a plastic material. The enclosure has a cylindrical shape, wherein the at least one opening is positioned at the end of the cylinder. The enclosure is fashioned from a contaminant resistant material and a transparent material.

The at least one opening and the endcap have a round shape, further wherein the endcap includes a plug configured to be inserted into the at least one opening, wherein the plug is configured to substantially maintain sufficient contact with the inner surface of the enclosure to remain in place until removed and filler material configured in the plug such that the aperture can be fashioned in the filler material.

In yet another aspect of the present invention, a method of producing an apparatus resistant to the growth and spread of contaminants comprises coupling a set of bristles to a handle portion of a brush, wherein the handle portion is fashioned from a contaminant resistant material, inserting the handle portion of the brush into an aperture of at least one endcap, fashioning an enclosure including at least one opening and inserting the at least one endcap into the at least one opening, wherein the at least one endcap is fashioned to close the at least one opening, and further wherein when the handle portion of the brush is inserted into the aperture and the at least one endcap is inserted into the at least one opening, the brush in entirely within the enclosure and configured such that the brush is not in contact with an inner surface of the enclosure.

The handle portion of the brush is fashioned from a stainless steel material. The handle portion of the brush includes an upper handle portion and a lower handle portion, wherein the lower handle portion is inserted into the aperture. The handle portion of the brush can be fashioned from a plastic material. The enclosure has a cylindrical shape, wherein the at least one opening is positioned at the end of the cylinder. The enclosure is fashioned from a contaminant resistant material and a transparent material.

The at least one opening and the at least one endcap have a round shape, further wherein the at least one endcap includes a plug configured to be inserted into the at least one opening, wherein the plug is configured to substantially maintain sufficient contact with the inner surface of the enclosure to remain in place until removed and filler material configured in the plug such that the aperture can be fashioned into the filler material.

DETAILED DESCRIPTION OF THE INVENTION

Figure 1:
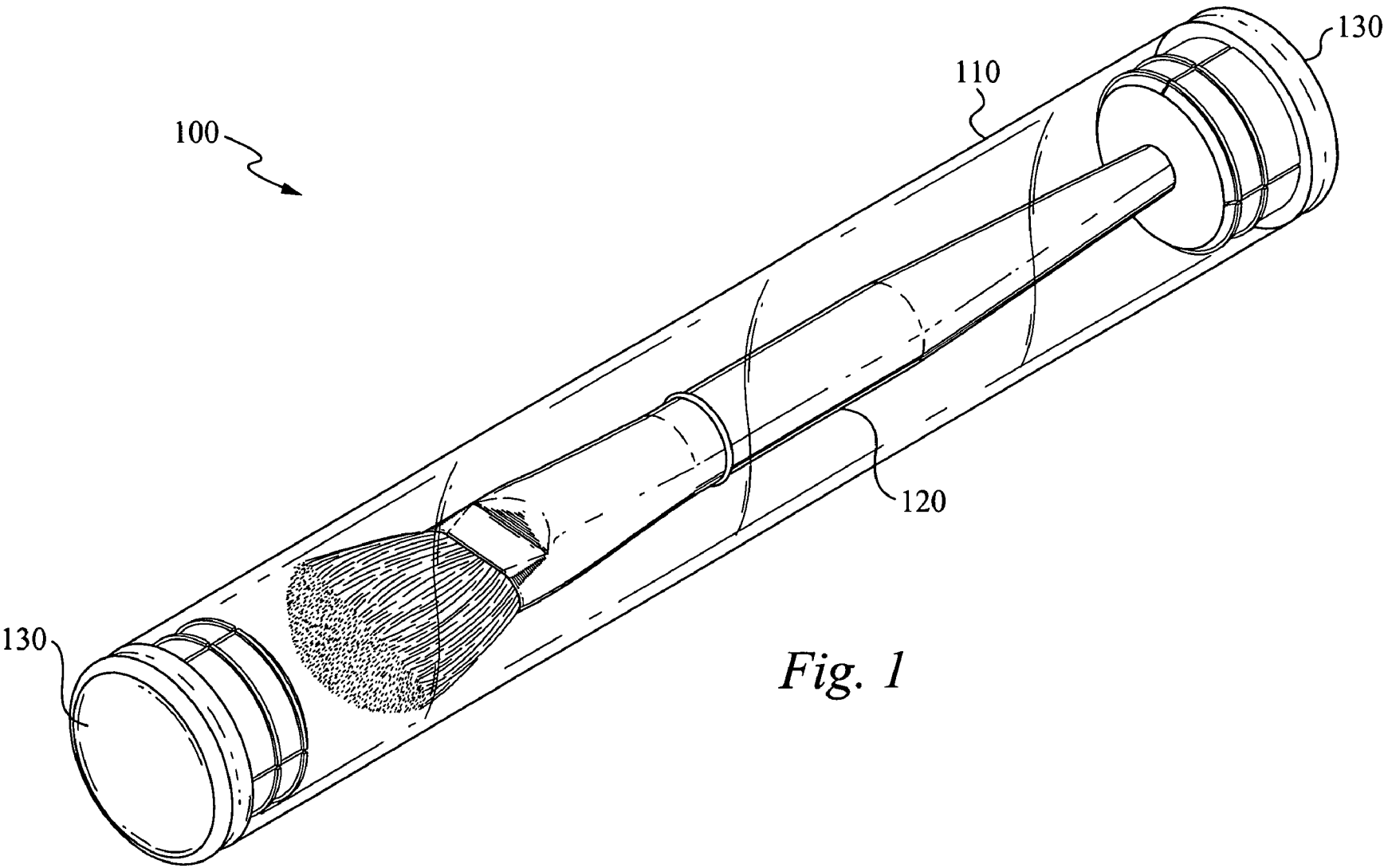
FIG. 1 is a graphical representation illustrating an exemplary apparatus according to an embodiment of the present invention.

FIG. 1 is a graphical representation of an embodiment of the present invention. The bacteria reducing apparatus 100 includes an enclosure 110, a brush 120 and preferably two endcaps 130. Preferably, the enclosure 110 is cylindrical and transparent, and the brush 120 is configured such that no part of the brush 120 is in contact with the enclosure 110. Preferably, the enclosure 110 is constructed of a material that resists the growth and spread of bacteria. Alternatively, the enclosure 110 may be of any shape and size that can house the brush 120, while keeping the brush 120 from touching the inner surface of the enclosure 110. The enclosure 110 may alternatively be constructed of a translucent or opaque material as well. The endcaps 130 include an aperture for receiving the brush 120 and further providing support so that the brush 120 does not touch the inner surface of the enclosure 110.

Figure 2A:
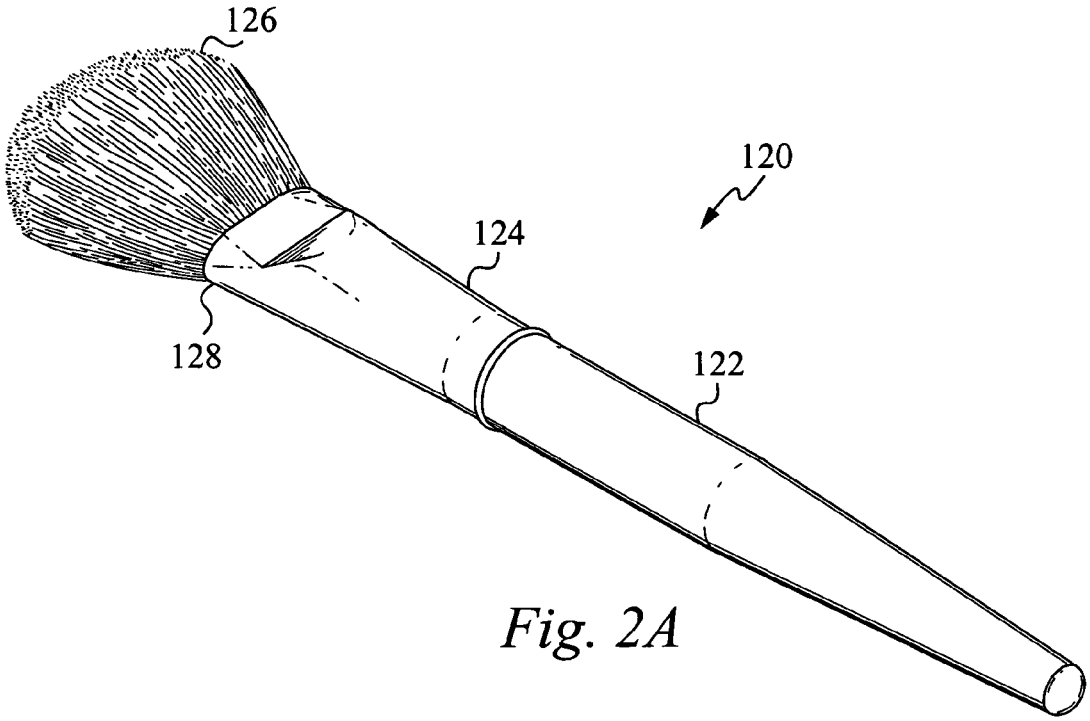
FIGS. 2*a* & 2*b* are graphical representations illustrating an exemplary brush according to an embodiment of the present invention.
Figure 2B:
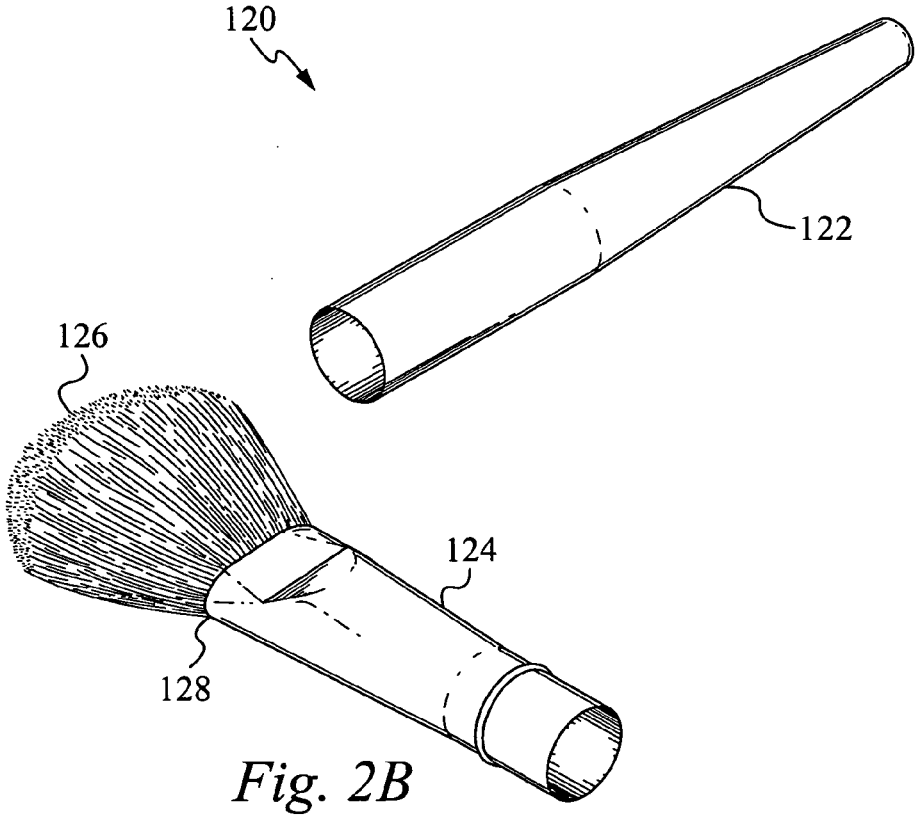

FIGS. 2*a* & 2*b* are graphical representations of the brush 120 according to an embodiment of the present invention. Preferably, the brush 120 includes a bottom handle 122 and a top handle 124, both constructed of a material that is resistant to the growth and spread of bacteria such as, but not limited to, stainless steel, aluminum or plastic materials. Preferably, the top handle 124 and bottom handle 122 are constructed of stainless steel. FIG. 2*b* illustrates the brush 120 of the present invention wherein the bottom handle 122 is detachable from the upper handle 124, as is contemplated in the preferred embodiment of the present invention. In this case, the stainless steel top handle 124 and bottom handle 122 are hollow. In alternative embodiments, the top and bottom handles 124, 122 may be a solid, continuous piece. Plastic handles could include such a handle design. The brush 120 also includes bristles 126 that are inserted into the top handle 124 and held in place by a crimp 128.

Figure 3:
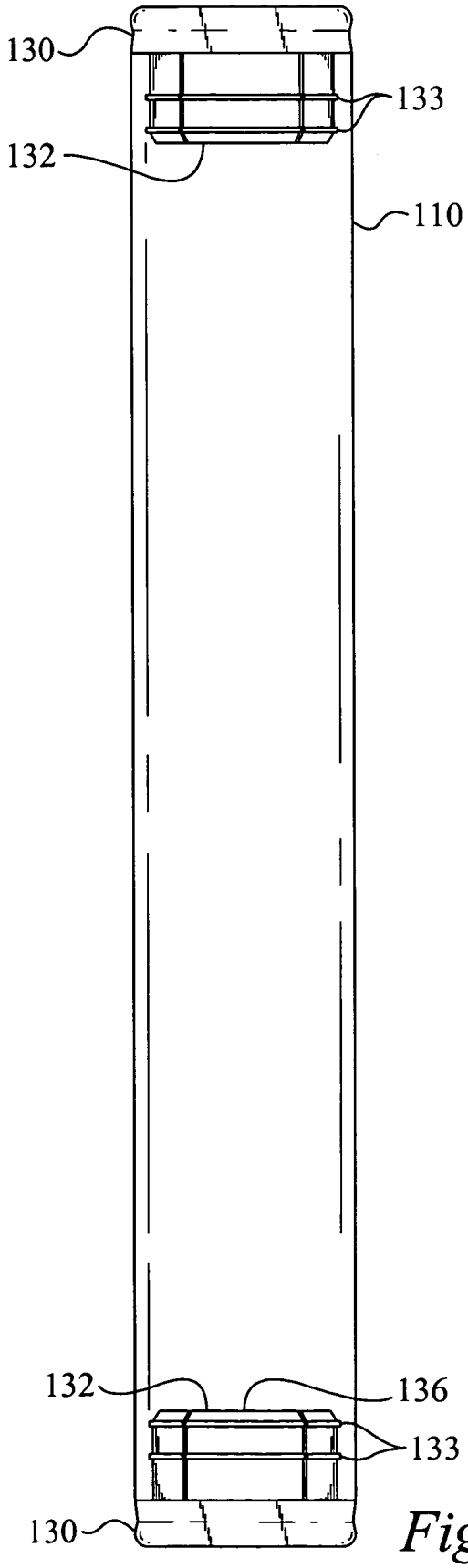
FIG. 3 is a graphical representation illustrating an exemplary re-useable enclosure according to an embodiment of the present invention.

FIG. 3 depicts the enclosure 110 of the preferred embodiment of the present invention. Again, the enclosure 110 is preferably cylindrical in shape and transparent such that the brush 120 (FIG. 2*a*) can be seen when inserted into the enclosure 110. The enclosure 110 is preferably closed by two endcaps 130. Alternatively, the enclosure 110 can be modified such that only one endcap 130 is needed to close the enclosure. The endcaps 130 include a plug 132 that protrudes into the enclosure 110. Preferably, the endcap 130 is held in position by ridges 133 that protrude from the plug 132 and touch the inner surface of the enclosure 110 in such a manner that the plug 132 will not fall out of the enclosure 110 if held toward the ground. Further, the endcap 130 is fashioned such that it closes the enclosure 110 from exposure to the air.

Figure 4A:
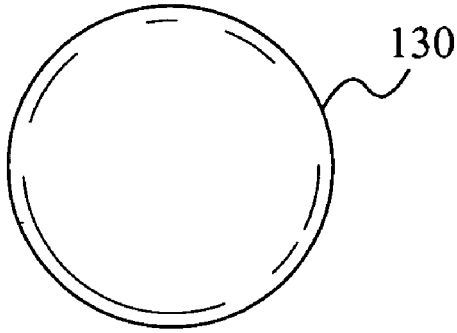
FIGS. 4*a*, 4*b* & 4*c* are graphical representations illustrating an endcap according to an embodiment of the present invention.
Figure 4B:
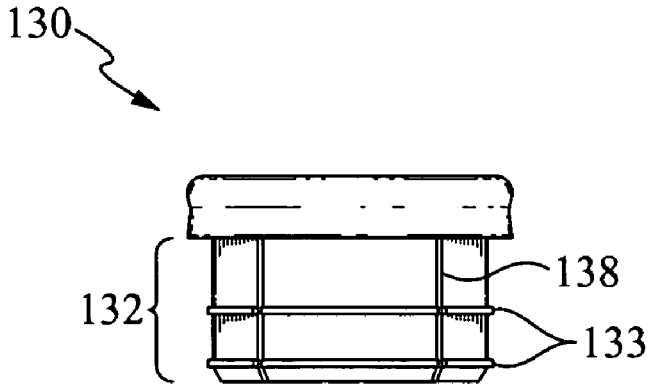
Figure 4C:
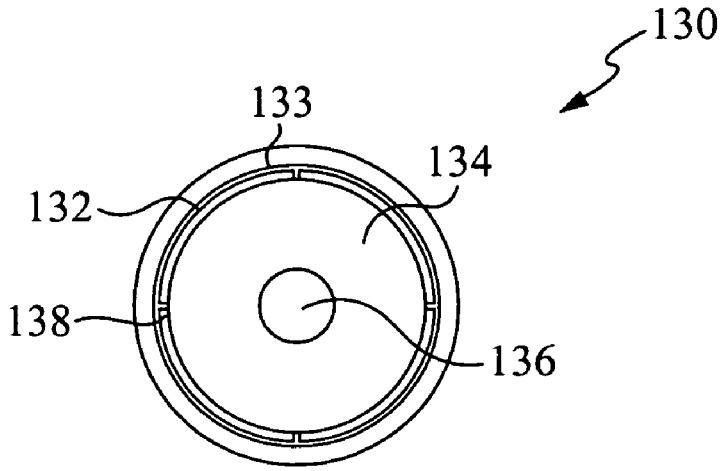

FIGS. 4*a*, 4*b* & 4*c* provide a more detailed view of the endcap 130 of the preferred embodiment of the present invention. In these figures, the endcap 130 includes the plug 132 having ridges 133 and slots 138. Preferably, the plug 132 includes a plurality of ridges 133 that make contact with the inner surface of the enclosure 110 (FIG. 1) and a plurality of slots 138 that allow the plug 132 to be flexible. The ridges 133 work in conjunction with the slots 138 to insure the plug 132 fits tightly into the end of the enclosure 110. Alternatively, the plug 132 may include as few as no slots 138 or ridges 133 depending on the size of the plug 132 and the desired fit of the plug 132 into the end of the enclosure 110.

Referring now to FIG. 4*c*, the endcap 130 preferably includes a filler 134 composed of a rubber material. The filler 134 preferably includes a handle aperture 136 that is configured to receive the lower handle 122 (FIG. 1) of the brush 120 such that when the plug 132 of the endcap 130 is inserted into the enclosure 110, no portion of the brush 120 touches the inner surface of the enclosure 110. Alternatively, the filler 134 may include some material other than rubber that is flexible enough to allow the bottom handle 122 to be inserted into it, thus expanding the aperture 136, while being rigid enough to hold the brush 120 in place as described above.

Still referring to FIG. 4*c*, an alternative endcap 130 of the present invention will not include a filler 134. Instead, the width of the plug 132, will be such that the handle aperture 136 will be formed by the inside surface (the surface opposite the ridges 133) of the plug 132 itself. Such an alternative embodiment is common in smaller brush 120 sizes.

Figure 5:
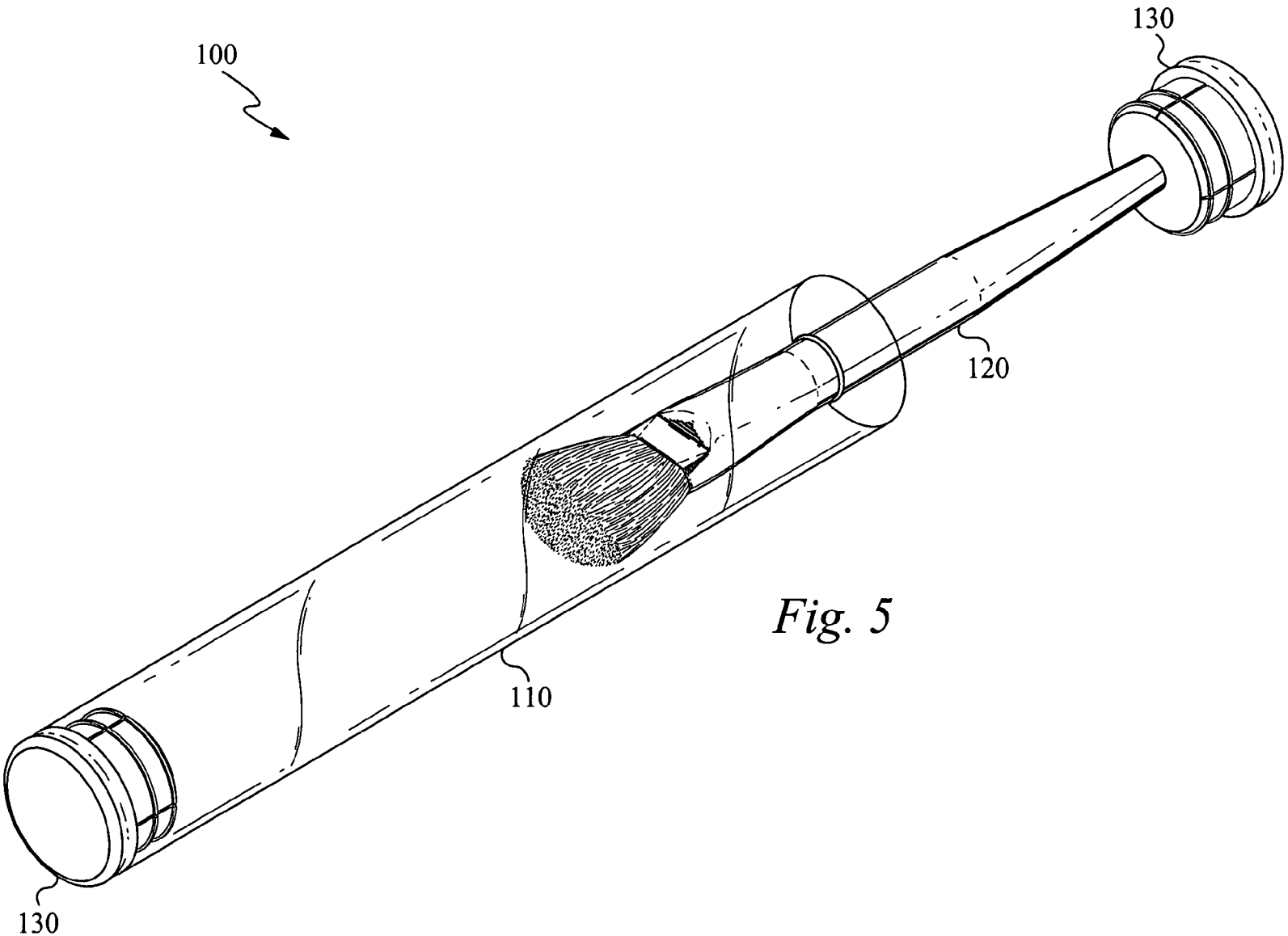
FIG. 5 is a graphical representation illustrating an exemplary apparatus according to an embodiment of the present invention.

Referring now to FIG. 5, the preferred embodiment of the bacteria reducing apparatus 100 is illustrated, and specifically the bacteria reducing apparatus 100 when the endcap 130 is inserted into or being removed from the enclosure 110 with the brush 120. Here, the brush 120 is held securely by the endcap 130 as described above. Again, when the brush 120 is being inserted as is depicted in FIG. 5, the brush 120 in configured to not touch the inner surface of the enclosure 110. After being removed, the brush 120 may be disconnected from the endcap 130 and used as desired.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device of the present invention could be implemented in several different ways and have several different appearances.

What is claimed is:

1. An apparatus for resisting the growth and spread of contaminants, the apparatus comprising:

a. cosmetic brush including a handle portion, wherein the handle portion is fashioned from a stainless steel material and the handle portion of the brush includes an upper handle portion and a lower handle portion;

b. a set of bristles coupled to the upper handle portion of the cosmetic brush;

c. at least one endcap including an aperture, wherein the aperture is fashioned to receive the lower handle portion of the brush; and d. an enclosure including at least one opening, wherein the at least one endcap is fashioned to close the at least one opening, and wherein the at least one opening and the at least one endcap have a round shape, further wherein the at least one endcap includes:

i. a plug with at least one wall configured to be inserted into the at least one opening, wherein the at least one wall of the plug is configured with at least one slot, and wherein the at least one wall flexes when inserted into the at least one opening causing the slot to become smaller; and ii. filler material positioned inside the at least one wall such that the aperture can be formed into the filler material; wherein when the lower handle portion of the cosmetic brush is inserted into the aperture and the at least one endcap is inserted into the at least one opening the cosmetic brush does not make contact with an inner surface of the enclosure and the at least one wall compresses the filler material.

2. The apparatus as claimed in claim 1 wherein the enclosure has a cylindrical shape, wherein the at least one opening is positioned at an end of the cylinder.

3. The apparatus as claimed in claim 1 wherein the enclosure is fashioned from a contaminant resistant material.

4. The apparatus as claimed in claim 1 wherein the enclosure is fashioned from a transparent material.

* * * * *